US005735001A

United States Patent [19]

Bitsche

[11] Patent Number: 5,735,001

[45] Date of Patent: Apr. 7, 1998

[54] STRUCTURAL BODY FOR WATER-HANDLING FIXTURE ASSEMBLY, VANITY TOP ASSEMBLY AND RELATED METHODS

[75] Inventor: William L. Bitsche, Hickory, N.C.

[73] Assignee: Leucadia, Inc., New York, N.Y.

[21] Appl. No.: 640,652

[22] Filed: May 1, 1996

[51] Int. Cl.[6] ..... E03C 1/33

[52] U.S. Cl. ..... 4/631

[58] Field of Search ..... 4/630–636, 619, 4/658; 312/140.1–140.4; 52/35; 108/27

[56] References Cited

U.S. PATENT DOCUMENTS

| | | | |
|---|---|---|---|
| D. 177,649 | 5/1956 | Stanitz | 4/631 X |
| 371,084 | 10/1887 | Mann | 4/631 |
| 1,453,945 | 5/1923 | Peterson . | |
| 2,057,405 | 10/1936 | Webber . | |
| 2,867,864 | 1/1959 | Githens . | |
| 2,895,778 | 7/1959 | Lieber | 108/27 |
| 3,292,966 | 12/1966 | Mariol . | |
| 4,347,793 | 9/1982 | Rajnert . | |
| 5,330,262 | 7/1994 | Peters . | |

FOREIGN PATENT DOCUMENTS

| | | | |
|---|---|---|---|
| 0402102 | 10/1968 | Australia | 108/27 |

*Primary Examiner*—Charles E. Phillips
*Attorney, Agent, or Firm*—Fulbright & Jaworski L.L.P.

[57] ABSTRACT

A structural body for a water-handling fixture assembly is alternatively usable as a right-hand or a left-hand body part in the assembly. A first edge of the body part is formed to orient in the assembly at an angle that is non-perpendicular in a first direction relative to a surface portion of another structural part of the assembly. A second edge, opposite the first, is formed to orient at an angle that is non-perpendicular in a second direction, opposite the first direction, relative to the surface portion. Formed as a side splash structure for a vanity top assembly of cultured stone, either of the edges of the body part can serve as a back or front edge so that, on either the left side or the right side, the large decoratively finished surface of the side splash structure can face inwardly in the vanity top assembly.

26 Claims, 3 Drawing Sheets

FIG. 3A
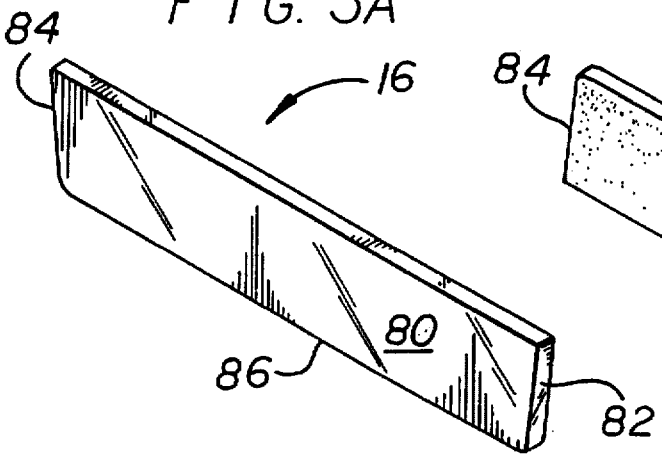
FIG. 3B
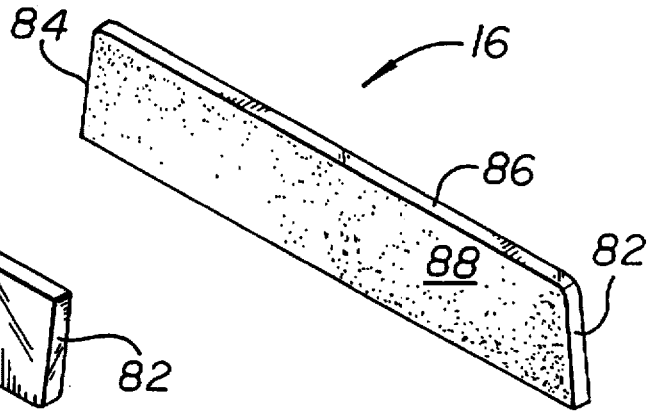
FIG. 4A
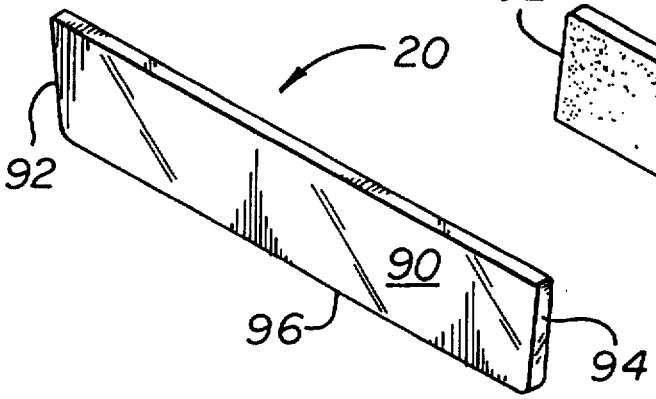
FIG. 4B
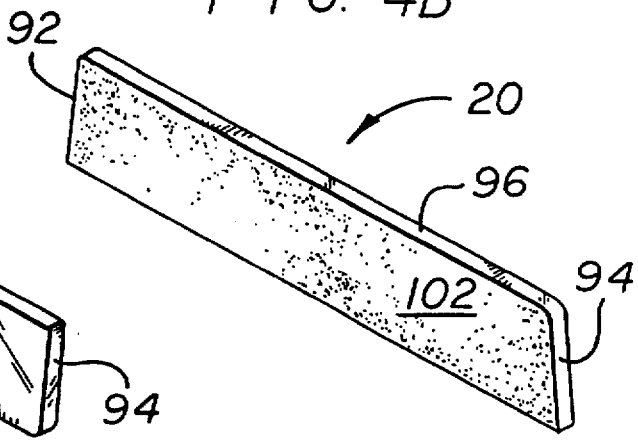
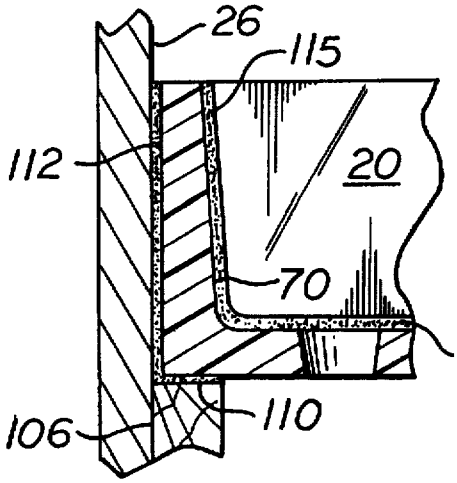
FIG. 5

STRUCTURAL BODY FOR WATER-HANDLING FIXTURE ASSEMBLY, VANITY TOP ASSEMBLY AND RELATED METHODS

FIELD OF THE INVENTION

The invention pertains to water fixture assemblies and methods of making them, and also, more particularly, to vanity top assemblies and methods of making those assemblies.

BACKGROUND OF THE INVENTION

Water fixture assemblies and their parts are now commonly made of cultured stone material. Among the water fixture assemblies to which this applies are vanity top assemblies.

The formation of the parts is accomplished using well known techniques and component materials, including polyester resin systems combined with organic and/or inorganic filler components. Typically, the components are blended and cast in an open mold after a gel-coat has been applied to the mold surface or parts of such surface.

The gel-coat is typically a polyester material formulated clear or pigmented (colored) and is designed for use as a protective and decorative coating for molded products. It can be sprayed on the mold surface, e.g. to an average thickness of in the range of about 0.012 to 0.015 inch.

The basic blend for the part can then be cast into the mold after the gel-coat cures to a tacky finish, with the cure driven by the introduction of a catalyst during the spray application of the gel-coat material. The basic blend, then, can be a combination of polyester resin, fillers, catalysts, and also, for example, a veining paste.

The major difference in forming different types of cultured stone is the difference in the filler. For example, for cultured marble, natural limestone deposits may be quarried, crushed and precise particle sizes can be blended in. For cultured onyx, a material derived from aluminum oxide, in the form of a fine white powder, provides a translucent look and appeal. For cultured granite, multi-colored crushed granite stone and minerals may be used.

Typically, after the basic blend is applied to the mold, the mold is closed and curing and hardening proceed. After the mold is opened, and trimmed of excessive flashing material, the product enters a state of heat building due to the chemical reactions. These reactions cause cross-linking of polymer chains to combine together into one mass, driving the reaction to a final cured state. After the part has hardened, it may be demolded, ground, sanded, and then polished.

Procedures and materials such as these are commonly used and well known.

The method of making these cultured stone components, as indicated, results in some surfacing, that formed with the gel-coat, having a finished and decorative appearance. On the other hand, such method also results in other surfacing having a rather unpleasant, unfinished appearance. This factor and the shapes and angles involved in the various parts and in how the parts come together in an assembly, create various inefficiencies and detriments in the production of cultured stone water-fixture assemblies.

For example, a cultured stone vanity top, commonly incorporates a single component that includes a basin, a counter, and a back splash that is angled somewhat rearwardly for reasons of function and appearance. Then, typically, one or two side splash components are provided.

Where the assembly is installed between two structural walls, two side splash components are usually used. Where there is a wall to only one side, a single side splash component is usually used, on that side only. Such a side splash typically is joined along the top outside portion of the counter and, at the rear, to the back splash. Because of the angle of the back splash, the side splash, when positioned, similarly is formed to have a rearward angle along the edge joined to the back splash. It also, typically, has a perpendicular angle along the edge at the front. As a result of these angle relationships, and of the fact that one of the two large surfaces of the side splash remains unfinished in the molding process, two different forms of side splash must be fabricated and available—a left side splash and a right side splash. In mass production and distribution, involving thousands and thousands of assemblies and their parts, factors such as this can be quite costly in terms of time and expense.

The present invention, among other aspects, addresses inefficiencies resulting from the formation of cultured stone components having finished and unfinished surfaces, and the various relationships in water-fixture assemblies in which such components are used.

SUMMARY OF THE INVENTION

In accordance with the invention, a structural body is provided for a water-handling fixture assembly. The body is alternatively usable as a right-hand or left-hand body part in the assembly. It has a first edge that is formed to orient in the assembly at an angle that is non-perpendicular in a first direction relative to a surface portion of another structural part of the assembly. It also has a second edge, opposite the first edge, that is formed to orient in the assembly at an angle that is non-perpendicular in a second direction, opposite the first direction, relative to the surface portion.

The non-perpendicular angles for the two edges are substantially identical in size and are greater than or equal to about two degrees.

In the structural body, a first surface, between the edge surfaces, is formed with a decorative finish, to orient inwardly, for viewing in the assembly. Then, a second surface, opposite the first surface, between the edges, is formed with a non-decorative finish, to orient outwardly, hidden from viewing in the assembly.

The edges have substantially identical, substantially rectangular shapes and the referenced surfaces have substantially identical, substantially trapezoidal shapes.

The body is a cast product, with the decorative finish simulating the appearance of a natural stone material such as marble, onyx or granite.

The structural body is usable as a substantially symmetrical right-hand or left-hand body part in the assembly.

In accordance with other structural aspects of the invention, the body part is incorporated into a vanity top assembly as a side splash structure. The non-perpendicular angles are relative to a surface portion of a counter structure of a vanity top assembly that also includes a basin structure, and a back splash structure having a front surface at a non-perpendicular angle relative to the counter surface portion. The non-perpendicular angles for the side splash structure are then angles of front and rear edges, the rear edges at a non-perpendicular angle rearwardly and the front edges at a non-perpendicular angle forwardly.

In accordance with method aspects of the invention, a method of making a water-handling fixture assembly incorporates the positioning and orientation of the structural body part in a water-fixture assembly. Similarly, a method of making a vanity top assembly incorporates the positioning and orientation of the structural body part, formed as a vanity top side splash structure, in a vanity top assembly.

In accordance with yet other structural aspects of the invention, a structural body for a water-handling fixture assembly includes a first pair of opposite edges, a second pair of opposite edges, and a pair of opposite surfaces between the first pair of edges and the second pair of edges, with each of the opposite surfaces having a substantially trapezoidal shape.

Each of the trapezoidal shapes is substantially symmetrical with both of the non-parallel sides at a non-perpendicular angle.

Similar to aspects of the structural body as initially set forth above, the non-perpendicular angle is greater than equal to about two degrees, one of the pair of opposite surfaces is formed with a decorative finish and the other is formed with a non-decorative finish, and other characteristics may also be analogous.

BRIEF DESCRIPTION OF THE DRAWINGS

FIG. 3A is a perspective view showing one of the two side splashes of the vanity top assembly of FIG. 1, with the large decorative surface of the side splash in view. FIG. 3B is a perspective view of the side splash of FIG. 3A with the large non-decorative surface of the side splash in view.

FIGS. 4A and 4B are analogous views to FIG. 3A and. FIG. 3B, for the second side splash of the vanity top assembly of FIG. 1.

FIG. 5 is cross-sectional view, partially broken away, taken along the line 5—5 of FIG. 1.

DETAILED DESCRIPTION

Figure 1:
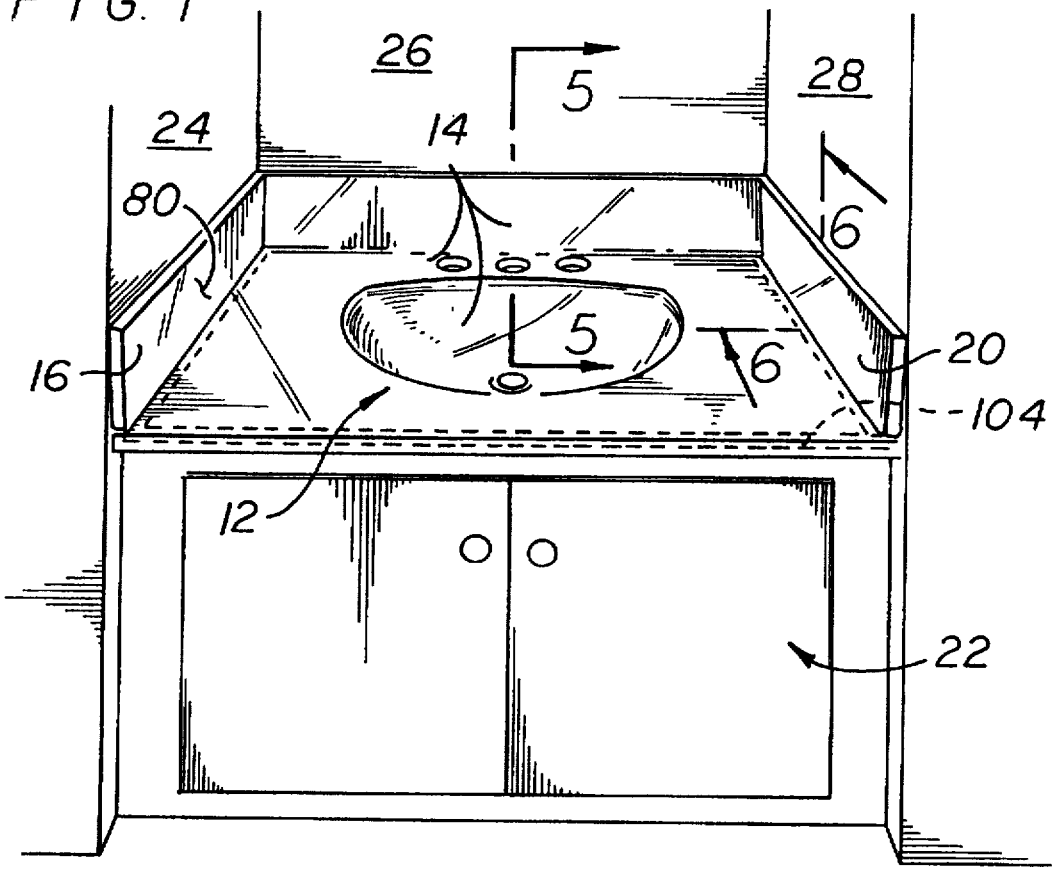
FIG. 1 is a perspective view showing a vanity top assembly in accordance with the invention, installed on a vanity cabinet between a pair of structural side walls and against a structural back wall.

A vanity top assembly 12 having parts made of cultured stone is shown in FIG. 1, installed and in position, but without the plumbing parts and connections. It is assembled from three cultured stone components. One of the components is an integral basin-counter-back splash structure 14. The other two components are left 16 and right 20 structural bodies, formed as side splashes.

The side splashes are assumed formed in the same mold using the same materials and procedures and are, thus, substantially identical.

Figure 2:
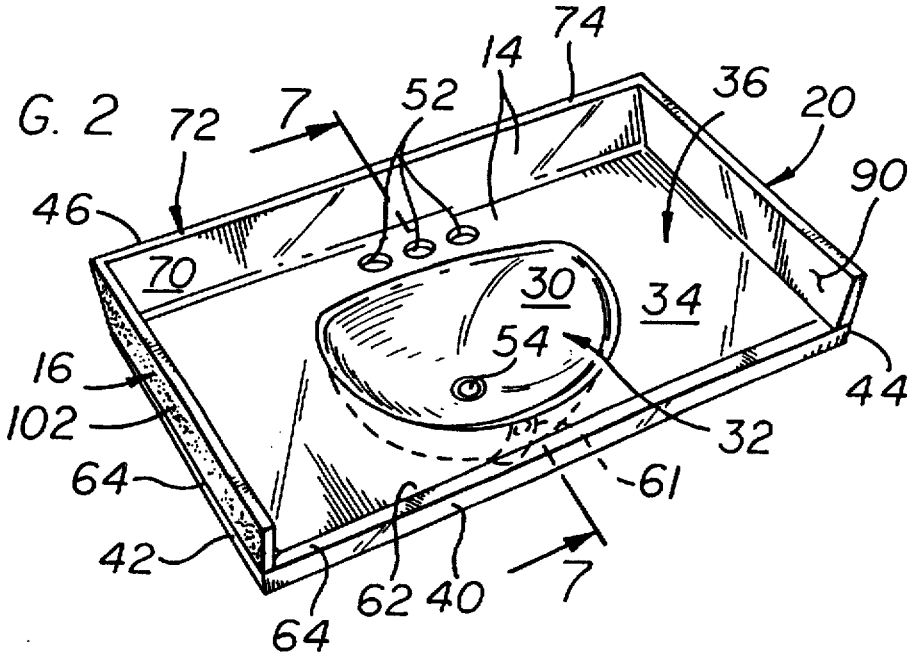
FIG. 2 is a perspective view showing the installed vanity top assembly of FIG. 1 with the cabinet and the structural walls about the vanity top assembly removed for convenience of viewing and understanding.

In FIG. 2, the installed vanity top assembly 12 is shown more clearly, with the vanity cabinet 22 not shown and with the left 24, right 26 and back 28 structural installation walls not shown so that the assembly can be seen more clearly.

The basin-counter-back splash structure 14, which might also be termed the base structure for the vanity top assembly, has been formed in accordance with ordinary manufacturing techniques for cultured stone, as summarized under the Background of the Invention. Therefore, those surfaces of the base meant to be viewed, when installed, are finished surfaces with a glossy decorative, gel-coat finish. On the other hand, many of the surfaces that are not to be seen are unfinished. Thus, the inside surface 30 of the basin 32 is a finished surface; and the top surface 34 of the counter 36, as well as the front edge 40 of the counter, are also finished surfaces. Although, when installed as in FIG. 1, the left 42 and right 44 edges of the counter are not to be seen, in accordance with normal casting and molding techniques, they are also finished surfaces. However, the underside 48 and back 49 surfaces of the counter, and the underside surface 50 of the basin, are unfinished.

After the plumbing for the faucets, drain and drain control are installed, from an appearance standpoint, it is not important whether the three openings 52 through the counter 36 and the drain opening 54 through the basin 32 have finished inside wall surfaces. However, in the embodiment shown, they are assumed to be finished.

Figure 7:
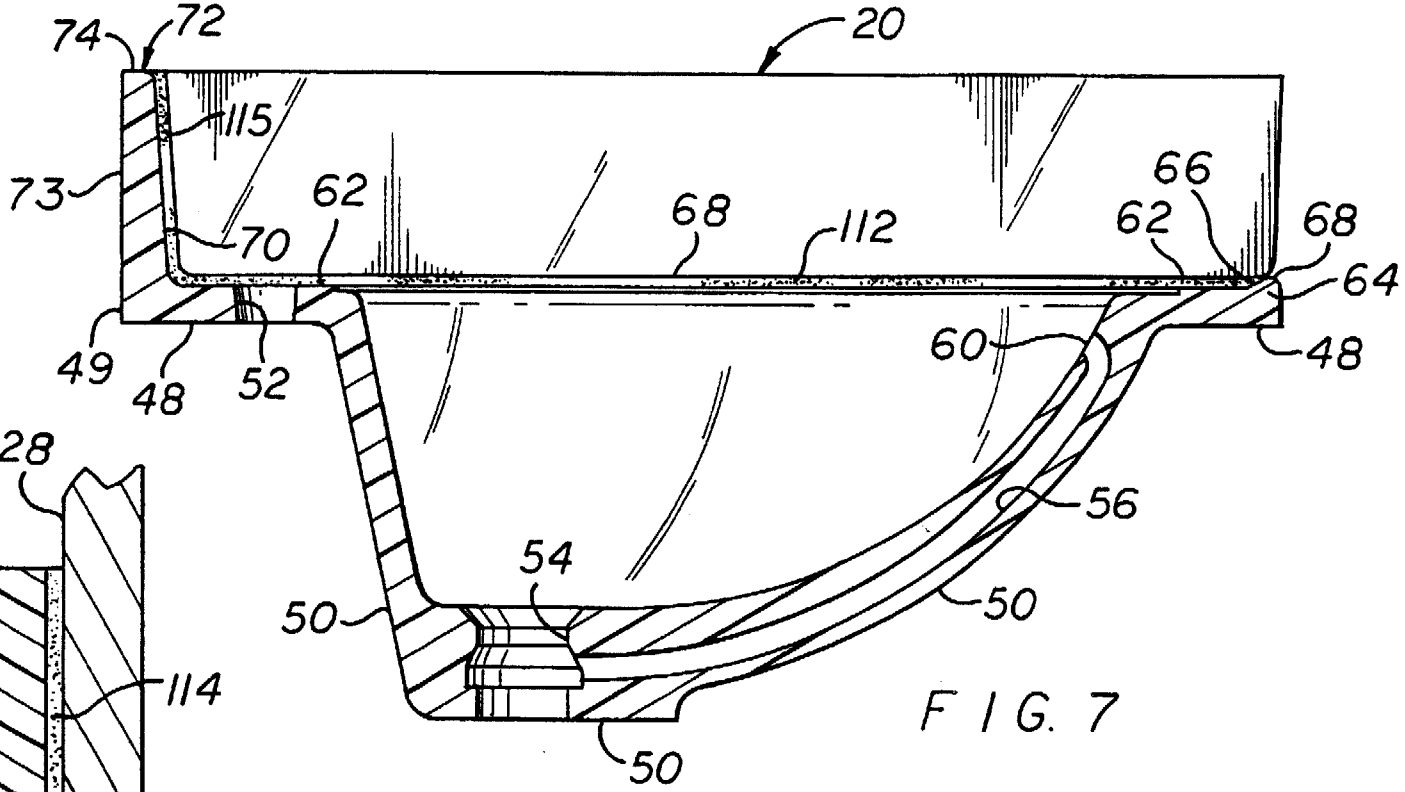
FIG. 7 is a cross-sectional view, taken along the line 7—7 of FIG. 2.

By reference to FIGS. 2 and 7, an overflow opening 56 running from an aperture 60 near the top of the basin to the drain opening 54 can also be seen. The walls of this opening are also assumed to be finished. Since overflow water will be running through that opening, the finish has a functional purpose. An outer contour 61 on the underside of the basin 32 for part of the wall structure for this overflow opening can seen in FIG. 2 (in phantom).

In the embodiment shown, a central portion 62 of the counter surface 34 is formed as a flat surface (e.g. FIGS. 7 and 2). Then, the counter 36 is also formed with a rim structure 64 at its outside periphery along the front and the two sides. The surface 66 for this rim has a peak 68 which, for example, can be seen at the front of the counter (in cross-section) and at the right side of the counter (in elevation) in FIG. 7.

A front surface 70 of the back splash 72 (e.g. FIGS. 2 and 7) is oriented at a non-perpendicular angle with reference to the orientation of the counter. This non-perpendicularity conveniently is measured with reference to the central surface 62 of counter and the peak 68 of the counter rim surface. Just as the central surface is substantially flat, the peak of the rim is at a substantially constant level above the flat central surface. Therefore, the non-perpendicular, backward angle of the front surface of the back splash is substantially the same angle as measured from either the central surface or the peak of the rim.

All of the surfaces of the back splash 72 are formed with the finished, decorative coating, apart from the back surface 73. Thus the finished surfaces include the front surface 70, the top surface 74 and the two side surfaces (not shown). In the case of the side surfaces, in the manner used and installed in FIG. 1, the finish is unnecessary for appearance purposes. It is of course apparent from the drawings that in the cross-sectional views of FIGS. 5, 6 and 7, the cross-sections themselves do not reveal the extremely thin coating or finish layer conventionally formed in accordance with cultured stone molding procedures.

The substantially identical left 16 and right 20 side splashes, prior to installation, are shown in FIGS. 3A and B and FIGS. 4A and B, respectively. Referring to FIG. 3A, the figure shows the large, inward surface 80 of the left side splash as well as the substantially planar back 82, front 84 and top 90 edges. In FIG. 3B, the substantially planar bottom edge 86 can be seen. These edge surfaces and the inwardly facing surface all are finished surfaces, with the decorative coating. However, the large outward surface 88, which is opposite the inward surface, is unfinished, and thus, has the rough, pocked appearance of unfinished cultural stone material.

As can be seen in FIG. 3, the back 82 and front 84 edges are opposite one another as are the top 90 and bottom edges 86, and the inward 80 and outward 88 surfaces. Additionally, the inward and outward surfaces are each disposed between each of the referenced pair of edges. Similarly, each edge in each pair is disposed between the outward and inward surfaces.

As can be further seen, the outward 88 and inward 80 surfaces have substantially identical trapezoidal shapes. In these trapezoidal shapes, the non-perpendicular angles of the front and back edges provide the non-parallel sides of the trapezoidal shape. On the other hand, the parallel top and bottom edges provide the parallel sides for the trapezoidal shape. Although the non-parallel sides of the trapezoidal shape are non-perpendicular in opposite directions, i.e., in position, one non-perpendicular rearwardly and the other forwardly, the magnitude or size of the non-perpendicular angles are equal and the side splash is substantially symmetrical about a transverse axis. Additionally, each of the four edge surfaces has a substantially rectangular shape. As is typical in cast and molded pieces, the side splash is formed with slightly rounded corners joining its edges and joining the edges and the outward and inward surfaces.

The right side splash 20, shown in FIGS. 4A and 4B prior to installation, is substantially identical to the left side splash 16. Therefore, it has a decoratively finished, outward surface 90, back edge 92, front edge 94, bottom edge 96, and top edge 100, each analogous to the same features of the left side splash 16. It also has an unfinished outward surface 102, analogous to the outward surface 88 of the left side splash. As is evident from the drawings, since the pair of side splash edges that are non-perpendicular, in fact, are both non-perpendicular, since they are non-perpendicular in opposite directions, and since the angles of the non-perpendicularity are substantially equal, either edge in fact can serve, as installed, as a back or front edge, with the large finished surface facing inwardly. And when installed, the two substantially identical side splashes are substantially symmetrical components in the vanity top assembly.

An angle, away from perpendicular, for the non-perpendicular edges of the side splash, in the range of greater than or equal to about 2 degrees and less than or equal to about 5 degrees is convenient and effective. A typical example is about 3 degrees. Similarly, an angle off-perpendicular for the front surface 70 of the back splash, in the range of greater than or equal to about 2 degrees and less than or equal to about 5 degrees is similarly convenient and effective. It, of course, is desirable for the size of this angle for the side splashes to be exactly the same as for the front surface of the back splash. However, given manufacturing tolerances and other considerations, such equality is not necessary. For example, the use of an adhesive substance disposed between joint surfaces of the side splashes in the vanity top assembly and the integral base that includes the basin 32, counter 36 and back splash 72 structures, can conveniently tolerate a lack of exactness, even beyond manufacturing tolerances. Thus, one form of side splash can be used with bases having some relatively small difference in the non-perpendicular angle of the front surface of the back splash. Commonly available silicone caulking substances, such as Dow-Corning RV-1, are convenient and effective.

Figure 6:
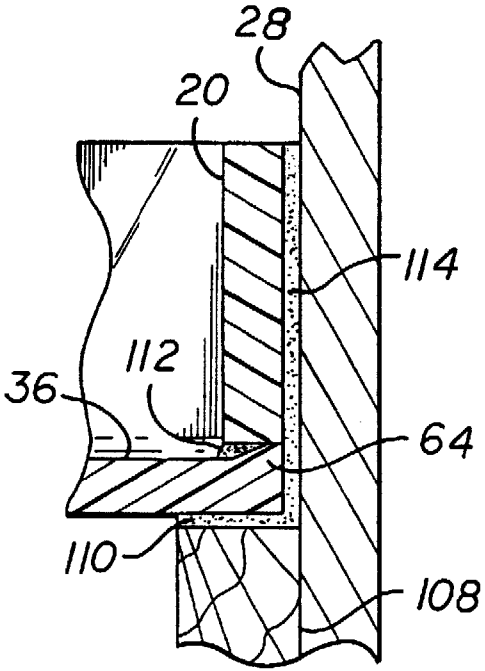
FIG. 6 is a cross-sectional view, partially broken away, taken along the line 6—6 of FIG. 1.

In the installation of the vanity top assembly, the base 14 is placed with the underside of the counter resting over the top edge of the vanity cabinet 22. Such a top edge 104 is shown (in phantom) in FIG. 1. As shown in FIGS. 5 and 6, a layer of the caulking substance is spread before the placement so that in the final installation, a layer of the substance is disposed between the top edge of the cabinet and the undersurface of the counter. The back wall 106 of the cabinet and the right side wall 108, with the layer 110 of caulking substance, disposed as just indicated, are shown in FIGS. 5 and 6. It is also advantageous to have the caulking substance disposed along portions of the back surface of the back splash 72 and of the counter 86, or in a layer along such surfaces, between those surfaces and the back wall against which the vanity top assembly is installed. The disposition of the substance there is shown at 112 in FIG. 5.

With the base 114 in position, the side splashes can then be installed, as indicated in FIGS. 1 and 2, with their large decorative surfaces 80 and 90 oriented inwardly, and open to view, and their large unfinished surfaces oriented outwardly and against the side installation walls and, thus, hidden from view. In installing the side splashes, it is advantageous to dispose a layer of the caulking substance between the bottom edge of the side splash and the upper surface of the counter in the vicinity of the rim where the side splash is positioned, and between the non-perpendicular back edge of the side splash and non-perpendicular front surface of the back splash. Similar to the back splash, it is also advantageous to dispose the substance as a complete layer between the outward oriented surface of the side splash and the side installation wall against which it is placed. Alternatively, the caulking may be disposed along portions of the area between the wall and the surface rather than as a complete layer. This can also be done between the side of the counter 36 and the side wall. Such caulking substance can be seen between the right side splash 20 and the counter 36 in FIGS. 5 and 6 at 112, between the right installation wall 28 and the right side splash and right side of the counter at 114 in FIG. 6, and between the edge of the right side splash and the front surface of the back splash at 115 in FIGS. 5 and 7.

The structural parts of the vanity top assembly 12 as described and shown, can be formed by the standard techniques and procedures for molding and making parts of cultured stone. By way of example, they might conveniently be made of cultured marble, cultured onyx, or cultured granite, with the decorative finish surfaces simulating the appearance of natural marble, onyx or granite.

Additionally, the embodiment of a vanity top assembly, as shown and described in detail, is installed between two installation walls and, thus, has a left and a right side splash structure. However, in many installations using the same parts, there will only be a right or left installation wall, with the other side of the assembly open. Of course, in those cases, there will only be a right or left side splash structure installed, against the installation wall that is present.

As will be readily apparent, many other changes and modifications may be made in the parts, assemblies, and methods described in detail, depending on the particular circumstances and application, context and requirements, without departing from the scope or spirit of the invention.

What is claimed is:

1. A vanity top assembly, comprising:

a basin structure;

a counter structure for the basin structure having a counter surface portion;

a back splash structure positioned near the rear of the assembly and having a front surface at a non-perpendicular angle relative to said counter surface portion; and a side splash structure positioned in the assembly and having a front edge at a non-perpendicular angle relative to said counter surface portion that is one of either forward or rearward from perpendicular relative to said counter surface portion, and having a back edge at a non-perpendicular angle relative to said counter surface portion that is the other one of either forward or rearward from perpendicular relative to said counter surface portion.

2. A vanity top assembly as defined in claim 1, wherein;

said non-perpendicular angles for said front and back edges of said side splash structures are substantially identical in size.

3. A vanity top assembly as defined in claim 2, wherein:

said non-perpendicular angles are greater than or equal to about two degrees.

4. A vanity top assembly as defined in claim 1, wherein:

said side splash structure has a finished inwardly facing surface and an unfinished outwardly facing surface opposite said inwardly facing surface.

5. A vanity top assembly as defined in claim 1, wherein:

said side splash structure is a cast product.

6. A vanity top assembly as defined in claim 4, wherein:

said finished surface of said side splash structure has a coating finish simulating the appearance of a natural stone material.

7. A vanity top assembly as defined in claim 6, wherein:

said coating finish simulates the appearance of a stone material selected from the group of marble, onyx and granite.

8. A vanity top assembly as defined in claim 1, further comprising:

a second side splash structure, substantially identical to said first side splash structure, positioned in the assembly, and having a front edge at a non-perpendicular angle relative to said counter surface portion that is one of either forward or rearward from perpendicular relative to said counter surface portion, and having a back edge at a non-perpendicular angle relative to said counter surface portion that is the other one of either forward or rearward from perpendicular relative to said counter surface portion.

9. A vanity top assembly as defined in claim 1, wherein:

each of said front and back edges of said side splash structure includes a substantially flat surface portion.

10. A vanity top assembly as defined in claim 1, wherein:

said front and back edges of said side splash structure are substantially flat surfaces.

11. A vanity top assembly as defined in claim 1, wherein:

said front edge of said side splash structure is uncovered for viewing in the vanity top assembly.

12. A vanity top assembly as defined in claim 1, wherein:

said front edge of said side splash structure forms a front surface for the vanity top assembly.

13. A vanity top assembly as defined in claim 11, wherein:

said back edge of said side splash structure is positioned forward of said back splash structure.

14. A vanity top assembly as defined in claim 1, wherein:

said side splash structure is positioned over said counter structure.

15. A method of making a vanity top assembly, comprising:

providing a basin structure, a counter structure for the basin structure having a surface portion, and a back splash structure positioned near the rear of the assembly and having a front surface at a non-perpendicular angle relative to said counter surface portion;

positioning a side splash structure in the assembly, including orienting said side splash structure with a front edge at a non-perpendicular angle relative to said surface portion that is one of either forward or rearward from perpendicular relative to said surface portion, and with a back edge at a non-perpendicular angle relative to said surface portion that is the other one of either forward or rearward from perpendicular relative to said surface portion.

16. A method of making a vanity top assembly as defined in claim 15, wherein:

said non-perpendicular angles for said front edges and said non-perpendicular angles for said back edges are substantially identical in size.

17. A method of making a vanity top assembly as defined in claim 16, wherein:

said non-perpendicular angles are greater than or equal to about two degrees.

18. A method of making a vanity top assembly as defined in claim 15, wherein:

said positioning step for said side splash structure includes orienting said side splash structure with a first side surface, between said front and back edges and formed with a decorative finish, for viewing in the assembly, and with a second side surface, opposite said first side surface, between said front and back edges and formed with a non-decorative finish, hidden from view.

19. A method of making a vanity top assembly as defined in claim 15, wherein:

said orienting of said first and second side surfaces for said side splash structure includes orienting said first side surface inwardly in the assembly and said second side surface outwardly in the assembly.

20. A method of making a vanity top assembly as defined in claim 15, further comprising:

positioning a second side splash structure substantially identical to said first side splash structure in the assembly, including orienting said second side splash structure with a front edge at a non-perpendicular angle relative to said surface portion that is one of either forward or rearward from perpendicular relative to said surface portion, and with a back edge at a non-perpendicular angle relative to said surface portion that is the other one of either forward or rearward relative to said surface portion.

21. A method of making a vanity top assembly as defined in claim 15, wherein:

said orienting includes orienting said side splash structure with said front edge including a substantially flat surface portion at said non-perpendicular angle.

22. A method of making a vanity top assembly as defined in claim 21, wherein:

said orienting includes orienting said side splash structure with said back edge including a substantially flat surface portion at said second non-perpendicular angle.

23. A method of making a vanity top assembly as defined in claim 15, wherein:

said orienting includes orienting said side splash structure with said front edge uncovered for viewing in the assembly.

24. A method of making a vanity top assembly as defined in claim 15, wherein:

said orienting includes orienting said side splash structure with said front edge of said side splash structure forming a front surface for the assembly.

25. A method of making a vanity top assembly as defined in claim 15, wherein:

said orienting includes orienting said side splash structure with said back edge of said side splash structure positioned forward of said back splash structure in the assembly.

26. A method of making a vanity top assembly as defined in claim 15, wherein:

said positioning includes positioning said side splash structure over said counter structure in the assembly.

* * * * *